US009296214B2

(12) United States Patent
Hunsberger, Jr.

(10) Patent No.: US 9,296,214 B2
(45) Date of Patent: Mar. 29, 2016

(54) THERMAL PRINT HEAD USAGE MONITOR AND METHOD FOR USING THE MONITOR

(75) Inventor: Alvin Hunsberger, Jr., New Britain, PA (US)

(73) Assignee: ZIH CORP., Lincolnshire, IL (US)

( * ) Notice: Subject to any disclaimer, the term of this patent is extended or adjusted under 35 U.S.C. 154(b) by 849 days.

(21) Appl. No.: 10/997,516

(22) Filed: Nov. 24, 2004

(65) Prior Publication Data

US 2006/0002753 A1 Jan. 5, 2006

Related U.S. Application Data

(60) Provisional application No. 60/608,947, filed on Jul. 2, 2004.

(51) Int. Cl.
*B41J 2/32* (2006.01)
*B41J 2/175* (2006.01)

(52) U.S. Cl.
CPC ..... *B41J 2/17546* (2013.01)

(58) Field of Classification Search
USPC ..... 347/7, 9, 19, 5, 14, 86, 10, 175; 358/1.15
IPC ..... B41J 11/009
See application file for complete search history.

(56) References Cited

U.S. PATENT DOCUMENTS 4,496,237 A 1/1985 Schron
4,513,298 A 4/1985 Scheu
4,551,000 A 11/1985 Kanemitsu
4,585,327 A 4/1986 Suzuki
4,634,258 A 1/1987 Tanaka
4,751,484 A 6/1988 Matsumoto
4,851,875 A 7/1989 Tanimoto
4,855,754 A 8/1989 Tanaka
4,870,459 A 9/1989 Ito et al.
4,882,604 A 11/1989 Kato
4,930,915 A 6/1990 Kikuchi
4,961,088 A 10/1990 Gilliland
4,970,531 A 11/1990 Shimizu
4,970,533 A 11/1990 Saito et al.
4,974,020 A 11/1990 Takamatsu
4,994,853 A 2/1991 Fukuchi
5,049,898 A 9/1991 Arthur
5,049,904 A 9/1991 Nakamura
5,066,978 A 11/1991 Watarai
5,078,523 A 1/1992 McGourty et al.
5,115,275 A 5/1992 Suzuki
5,132,729 A 7/1992 Matsushita
(Continued)

FOREIGN PATENT DOCUMENTS

DE 199 54 749 A1 5/2001
EP 0 551 752 A2 12/1992
(Continued)

OTHER PUBLICATIONS

Sakai et al., Pub. No. US2001/0048459 A1; Pub. Date Dec. 6, 2001.
(Continued)

*Primary Examiner* — Lam Nguyen

(57) ABSTRACT

A data acquisition unit for use in monitoring print head activity and collecting corresponding data for product analysis is disclosed. A method of using the data acquisition unit is also disclosed.

19 Claims, 3 Drawing Sheets

(56) References Cited

U.S. PATENT DOCUMENTS 5,137,379 A 8/1992 Ukai
5,148,534 A 9/1992 Comerford
5,206,685 A 4/1993 Hara
5,216,464 A 6/1993 Kotani
5,266,968 A 11/1993 Stephenson
5,272,503 A 12/1993 Lesueur
5,276,461 A 1/1994 Saito
5,283,597 A 2/1994 Yoshida
5,283,613 A 2/1994 Midgley
5,300,954 A 4/1994 Murano et al.
5,304,007 A 4/1994 Flanagan
5,315,320 A 5/1994 Murano
5,318,370 A 6/1994 Nehowig
5,319,426 A 6/1994 Baruch
5,333,960 A 8/1994 Nam
5,363,134 A 11/1994 Barbehenn
5,371,525 A 12/1994 Murano
5,385,416 A 1/1995 Maekawa
5,410,641 A 4/1995 Wakabayashi
5,414,452 A 5/1995 Accatino et al.
5,452,059 A 9/1995 Sekiya
5,455,617 A 10/1995 Stephenson
5,479,467 A 12/1995 Katsumata
5,486,057 A 1/1996 Skinner et al.
5,489,971 A 2/1996 Nam
5,491,540 A 2/1996 Hirst
5,510,884 A 4/1996 Bov
5,512,988 A 4/1996 Donaldson
5,528,277 A 6/1996 Nardone et al.
5,546,163 A 8/1996 Asai
5,548,374 A 8/1996 Iguchi
5,570,123 A 10/1996 Almonte
5,572,292 A 11/1996 Chatani
5,579,088 A 11/1996 Ko
5,585,825 A 12/1996 Kneezel et al.
5,589,868 A 12/1996 Schofield et al.
5,610,635 A 3/1997 Murray
5,627,572 A 5/1997 Harrington
5,636,032 A 6/1997 Springett
5,646,660 A 7/1997 Murray
5,657,066 A 8/1997 Adams et al.
5,666,585 A 9/1997 Nagira
5,671,002 A 9/1997 Murano
5,699,091 A 12/1997 Bullock
5,699,100 A * 12/1997 Fukuda ..... B41J 2/32 347/175
5,706,037 A 1/1998 Mcintyre
5,708,912 A 1/1998 Lee
5,717,974 A 2/1998 Park
RE35,751 E 3/1998 Midgley
5,755,519 A 5/1998 Klinefelter
5,760,795 A 6/1998 Beck
5,768,991 A 6/1998 Cless et al.
5,786,828 A 7/1998 Yamamoto
5,787,278 A 7/1998 Barton
5,788,388 A 8/1998 Cowger
5,794,095 A 8/1998 Thompson
5,797,060 A 8/1998 Thompson
5,797,061 A 8/1998 Overall
5,807,005 A 9/1998 Wright
5,812,156 A * 9/1998 Bullock et al. ..... 347/19
5,812,902 A 9/1998 Lee
5,816,718 A 10/1998 Poole
5,823,690 A 10/1998 Narushima
5,831,649 A 11/1998 Watrobski
5,835,817 A 11/1998 Bullock
5,835,818 A 11/1998 Hoshika
5,838,358 A 11/1998 Suzuki
5,847,814 A 12/1998 Antziopoulos
5,848,848 A 12/1998 St. Jean
5,860,363 A 1/1999 Childers
5,874,980 A 2/1999 West
5,877,692 A 3/1999 Watanabe
5,878,298 A 3/1999 Nakano
5,907,739 A 5/1999 Tsunemi
5,907,748 A 5/1999 Kawana
5,909,233 A 6/1999 Hamman et al.
5,926,192 A * 7/1999 Yamane ..... B41J 2/5056 347/10
5,926,665 A 7/1999 Suzuki
5,926,666 A 7/1999 Miura
5,930,553 A 7/1999 Hirst
5,937,225 A 8/1999 Samuels
5,940,095 A 8/1999 Parish
5,950,038 A 9/1999 Okui
5,963,759 A 10/1999 Kojima
5,966,144 A * 10/1999 Edwards ..... 347/7
5,978,004 A 11/1999 Ehrhardt
5,995,774 A 11/1999 Applegate
6,000,773 A 12/1999 Murray
6,011,937 A 1/2000 Chaussade
6,014,533 A 1/2000 Kawana
6,016,409 A 1/2000 Beard
6,019,449 A 2/2000 Bullock
6,019,461 A 2/2000 Yoshimura
6,022,094 A 2/2000 Gibson
6,028,674 A 2/2000 Tognazzini
6,039,430 A 3/2000 Helterline
6,057,870 A 5/2000 Monnier et al.
6,065,824 A 5/2000 Bullock
6,068,372 A 5/2000 Rousseau
6,068,415 A 5/2000 Smolenski
6,070,805 A 6/2000 Kaufman et al.
6,089,687 A 7/2000 Helterline
6,097,906 A 8/2000 Matsuzaki
6,099,101 A 8/2000 Maurelli
6,099,178 A 8/2000 Spurr
6,106,088 A * 8/2000 Wafler ..... 347/7
6,106,166 A 8/2000 Spurr
6,112,036 A 8/2000 Shinohara
6,113,208 A 9/2000 Benjamin
6,126,265 A 10/2000 Childers
6,144,812 A 11/2000 Ueno
6,147,767 A 11/2000 Petteruti et al.
6,151,037 A 11/2000 Kaufman et al.
6,151,041 A 11/2000 Bolash
6,158,837 A 12/2000 Hilton
6,158,850 A 12/2000 Cook
6,161,913 A 12/2000 Childers
6,161,916 A 12/2000 Gibson
6,163,658 A 12/2000 Suzuki
6,173,128 B1 1/2001 Saber
6,181,885 B1 1/2001 Best
6,188,423 B1 2/2001 Pou
6,188,852 B1 2/2001 Ojima
6,195,115 B1 2/2001 Yamaguchi
6,196,670 B1 * 3/2001 Saruta ..... 347/86
6,196,736 B1 3/2001 Otsuki
6,227,643 B1 5/2001 Purcell
6,233,409 B1 5/2001 Haines
6,243,120 B1 6/2001 Hevenor
6,263,170 B1 7/2001 Bortnem
6,264,301 B1 7/2001 Helterline
6,266,492 B1 7/2001 Maehara
6,267,463 B1 7/2001 Paulsen
6,271,928 B1 8/2001 Bullock
6,286,923 B1 9/2001 Sugahara
6,295,423 B1 9/2001 Haines
6,302,527 B1 10/2001 Walker
6,305,795 B2 10/2001 Childers
6,312,072 B1 11/2001 Hough
6,312,083 B1 11/2001 Moore
6,312,106 B1 11/2001 Walker
6,325,495 B1 12/2001 Foth
6,332,062 B1 12/2001 Phillips
6,339,684 B1 1/2002 Sato
6,343,193 B1 1/2002 Matsumoto
6,349,182 B2 2/2002 Otsubo
6,351,618 B1 2/2002 Pollocks
6,351,621 B1 2/2002 Richards
6,363,226 B1 3/2002 Batori
6,366,742 B1 4/2002 Reihl
6,375,301 B1 4/2002 Childers
6,381,418 B1 4/2002 Spurr

(56) References Cited

U.S. PATENT DOCUMENTS

| | | | | |
|---|---|---|---|---|
| 6,381,419 | B1 | 4/2002 | Kinoshita | |
| 6,385,407 | B1 | 5/2002 | Inose | |
| 6,386,772 | B1 | 5/2002 | Klinefelter | |
| 6,406,120 | B2 | 6/2002 | Pauschinger | |
| 6,408,141 | B1 | 6/2002 | Tahara | |
| 6,409,298 | B1 * | 6/2002 | Ahne et al. | 347/14 |
| 6,409,401 | B1 | 6/2002 | Petteruti et al. | |
| 6,418,283 | B1 | 7/2002 | Wegman | |
| 6,427,054 | B1 | 7/2002 | Ohkubo | |
| 6,431,703 | B2 | 8/2002 | Rousseau | |
| 6,438,329 | B1 | 8/2002 | Budnik | |
| 6,454,381 | B1 | 9/2002 | Olsen | |
| 6,459,860 | B1 | 10/2002 | Childers | |
| 6,464,322 | B2 | 10/2002 | Dunand | |
| 6,467,864 | B1 | 10/2002 | Cornell | |
| 6,467,888 | B2 | 10/2002 | Wheeler | |
| 6,473,571 | B1 | 10/2002 | Wegman | |
| 6,478,399 | B1 | 11/2002 | Mitsuzawa | |
| 6,481,907 | B2 | 11/2002 | Banach et al. | |
| 6,488,352 | B1 | 12/2002 | Helterline | |
| 6,490,420 | B2 | 12/2002 | Pollocks | |
| 6,493,519 | B2 | 12/2002 | Sasame | |
| 6,498,905 | B1 | 12/2002 | Tsuruya | |
| 6,502,917 | B1 | 1/2003 | Shinada | |
| 6,505,013 | B1 | 1/2003 | Bedford | |
| 6,505,926 | B1 | 1/2003 | Trafton | |
| 6,511,142 | B1 | 1/2003 | Carmon | |
| 6,512,894 | B2 | 1/2003 | Takemoto | |
| 6,522,348 | B1 | 2/2003 | Brot | |
| 6,523,926 | B1 | 2/2003 | Mitsuzawa et al. | |
| 6,527,356 | B1 | 3/2003 | Spurr | |
| 6,532,351 | B2 | 3/2003 | Richards | |
| 6,535,697 | B2 | 3/2003 | Reihl | |
| 6,539,867 | B2 | 4/2003 | Lee | |
| 6,546,211 | B1 | 4/2003 | Shishikura | |
| 6,546,212 | B1 | 4/2003 | Ogata | |
| 6,550,902 | B2 | 4/2003 | Shinada | |
| 6,556,792 | B2 | 4/2003 | Yoshimura | |
| 6,559,973 | B2 | 5/2003 | Bullock | |
| 6,565,176 | B2 | 5/2003 | Anderson | |
| 6,565,198 | B2 | 5/2003 | Saruta | |
| 6,583,803 | B2 | 6/2003 | Poole et al. | |
| 6,584,290 | B2 | 6/2003 | Kurz | |
| 6,584,291 | B1 | 6/2003 | Yamamoto | |
| 6,587,649 | B1 | 7/2003 | Yamamoto | |
| 6,588,872 | B2 | 7/2003 | Anderson | |
| 6,593,952 | B1 | 7/2003 | Funayama | |
| 6,597,875 | B2 | 7/2003 | Hasegawa | |
| 6,597,876 | B1 | 7/2003 | Sakurai | |
| 6,603,497 | B2 | 8/2003 | Hevenor | |
| 6,608,975 | B2 | 8/2003 | Sakurai | |
| 6,621,989 | B2 | 9/2003 | Otomo | |
| 6,625,402 | B2 | 9/2003 | Takemoto | |
| 6,629,134 | B2 | 9/2003 | Hayward | |
| 6,634,738 | B1 | 10/2003 | Shinada | |
| 6,636,702 | B2 | 10/2003 | Abe | |
| 6,644,544 | B1 | 11/2003 | Spurr | |
| 6,644,771 | B1 | 11/2003 | Silverbrook | |
| 6,683,638 | B2 | 1/2004 | Sato | |
| 6,687,634 | B2 | 2/2004 | Borg | |
| 6,694,107 | B2 | 2/2004 | Sakurai | |
| RE38,473 | E | 3/2004 | Smolenski | |
| 6,708,005 | B2 | 3/2004 | Chihara | |
| 6,714,745 | B2 | 3/2004 | Sasame | |
| 6,722,753 | B2 | 4/2004 | Helterline | |
| 6,735,399 | B2 | 5/2004 | Tabb | |
| 6,738,903 | B1 | 5/2004 | Haines | |
| 6,748,182 | B2 | 6/2004 | Yoshida | |
| 6,791,704 | B1 | 9/2004 | Moreau | |
| 6,793,307 | B2 | 9/2004 | Spurr | |
| 6,798,997 | B1 | 9/2004 | Hayward | |
| 6,799,001 | B2 | 9/2004 | Takeuchi | |
| 6,802,659 | B2 | 10/2004 | Cremon | |
| 6,807,380 | B2 | 10/2004 | Iida | |
| 6,807,382 | B1 | 10/2004 | Sakurai | |
| 6,820,039 | B2 | 11/2004 | Johnson | |
| 6,853,814 | B2 | 2/2005 | Ito | |
| 6,871,027 | B2 | 3/2005 | Ito | |
| 6,879,785 | B2 | 4/2005 | Ito | |
| 6,879,786 | B2 | 4/2005 | Ito | |
| 6,894,711 | B2 | 5/2005 | Yamakawa | |
| 6,903,837 | B1 | 6/2005 | Moreau | |
| 6,904,242 | B2 | 6/2005 | Ito | |
| 6,963,351 | B2 | 11/2005 | Squires | |
| 7,025,268 | B2 | 4/2006 | Alleshouse | |
| 7,106,198 | B2 * | 9/2006 | Phipps et al. | 340/572.1 |
| 7,245,312 | B2 | 7/2007 | Smolenski et al. | |
| 7,372,475 | B2 | 5/2008 | Vazac et al. | |
| 7,398,054 | B2 | 7/2008 | Tsirline et al. | |
| 7,407,102 | B2 | 8/2008 | Alleshouse | |
| 7,498,942 | B2 | 3/2009 | Torchalski et al. | |
| 7,500,797 | B2 | 3/2009 | Boisdon et al. | |
| 2002/0060708 | A1 | 5/2002 | Elliott | |
| 2002/0063760 | A1 | 5/2002 | Dietl | |
| 2002/0140751 | A1 | 10/2002 | Imanaka et al. | |
| 2002/0163662 | A1 | 11/2002 | Kaufman et al. | |
| 2004/0051751 | A1 | 3/2004 | Sekiya | |
| 2004/0080551 | A1 * | 4/2004 | Nunokawa | 347/5 |
| 2004/0080775 | A1 * | 4/2004 | Owen et al. | 358/1.14 |
| 2004/0125160 | A1 * | 7/2004 | Anderson et al. | 347/14 |
| 2004/0141019 | A1 | 7/2004 | Schloeman et al. | |
| 2005/0084315 | A1 | 4/2005 | Lodwig et al. | |
| 2005/0116975 | A1 | 6/2005 | Kasai | |
| 2005/0210610 | A1 | 9/2005 | Louie et al. | |
| 2006/0002753 | A1 | 1/2006 | Hunsberger, Jr. | |
| 2006/0020803 | A1 | 1/2006 | O'Hagan | |
| 2006/0164447 | A1 | 7/2006 | Poole et al. | |
| 2006/0171755 | A1 | 8/2006 | Clarke | |
| 2006/0221167 | A1 | 10/2006 | Maynard et al. | |
| 2006/0251461 | A1 | 11/2006 | Lodwig et al. | |
| 2007/0023068 | A1 | 2/2007 | Helma | |
| 2007/0031617 | A1 | 2/2007 | Field | |
| 2007/0081842 | A1 | 4/2007 | Ehrhardt, Jr. | |
| 2007/0099462 | A1 | 5/2007 | Helma et al. | |
| 2007/0147938 | A1 | 6/2007 | Brown et al. | |
| 2007/0212142 | A1 | 9/2007 | Zevin et al. | |
| 2008/0030771 | A1 | 2/2008 | Alleshouse | |
| 2008/0211840 | A1 | 9/2008 | Zevin et al. | |

FOREIGN PATENT DOCUMENTS

| | | | |
|---|---|---|---|
| EP | 0 551 752 | A3 | 12/1992 |
| EP | 0 766 195 | A2 | 4/1997 |
| EP | 0 802 059 | A2 | 10/1997 |
| EP | 0 935 211 | A2 | 8/1999 |
| EP | 1 182 039 | A1 | 2/2002 |
| EP | 1 300 250 | A2 | 4/2003 |
| JP | 50-116227 | A | 9/1975 |
| JP | 09065148 | * | 3/1997 |
| WO | WO 03/021390 | A2 | 3/2003 |

OTHER PUBLICATIONS

International Preliminary Report on Patentability for Application No. PCT/US2005/009771; dated Jan. 9, 2007.

International Search Report for Application No. PCT/US2005/009771; dated Aug. 10, 2005.

Office Action for Chinese Application No. 200580029037.6; dated Aug. 31, 2008.

Office Action for Chinese Application No. 200580029037.6; dated Sep. 4, 2009.

Office Action for Chinese Application No. 200580029037.6; dated May 27, 2011.

Extended European Search Report for European Patent Application No. 10011174.9, dated Dec. 2, 2010.

International Search Report for International Application No. PCT/US2006/039013, mailed on Feb. 27, 2007.

* cited by examiner

THERMAL PRINT HEAD USAGE MONITOR AND METHOD FOR USING THE MONITOR

CROSS REFERENCE TO RELATED APPLICATION

This application claims the benefit of U.S. Provisional Application No. 60/608,947, filed Jul. 2, 2004, which is incorporated by reference as if fully set forth.

BACKGROUND

The present invention is generally directed to a print head monitor and, more specifically, to a thermal printing system and method for monitoring thermal print head usage.

While many different types of thermal print heads are commonly used in business and residential printers, known print heads share common drawbacks. For example, when an allegedly defective thermal print head is returned to a manufacturer or distributor, it is usually difficult to determine whether the thermal print head is actually defective or whether the print head has been misused. Thermal print heads are designed for specific operating conditions and, depending upon the printer in which they are installed, may malfunction due to use outside of design parameters. Additionally, it can be difficult to determine how much actual use a consumer obtained from the print head prior to malfunction.

It would be advantageous to have a monitor or printing system that monitors thermal print head usage; that preferably stores print head operational and performance specifications; that preferably stores actual print head operating characteristics; that preferably provides data that can be used to optimize print head design parameters; and that preferably interfaces with remote operating systems.

SUMMARY

A thermal print head data acquisition unit that monitors print head functions and accumulates corresponding data which may be stored in a memory. A printing system with the data acquisition unit connected to the print head driver circuit will provide data that is useful in the analysis of print head use conditions and failure causes. The data acquisition unit may be assembled on board the print head or connected through an external connection, such as a USB, so that the data is transmitted to another part of the printing system or to an remote computer or memory.

BRIEF DESCRIPTION OF THE DRAWING(S)

The foregoing summary, as well as the following detailed description of the preferred embodiment of the present invention, will be better understood when read in conjunction with the appended drawings. For the purpose of illustrating the invention, there is shown in the drawings an embodiment which is presently preferred. It is understood, however, that the present invention is not limited to the precise arrangement and instrumentality shown. In the drawings.

DETAILED DESCRIPTION OF THE PREFERRED EMBODIMENT(S)

Certain terminology is used in the following description for convenience only and is not limiting. The term "linear print" means "linear print by a print head based on the printing having a specific resolution." The words "a" and "one", as used in the claims and in the corresponding portions of the specification, are defined as including one or more of the referenced item unless specifically stated otherwise.

Figure 1:
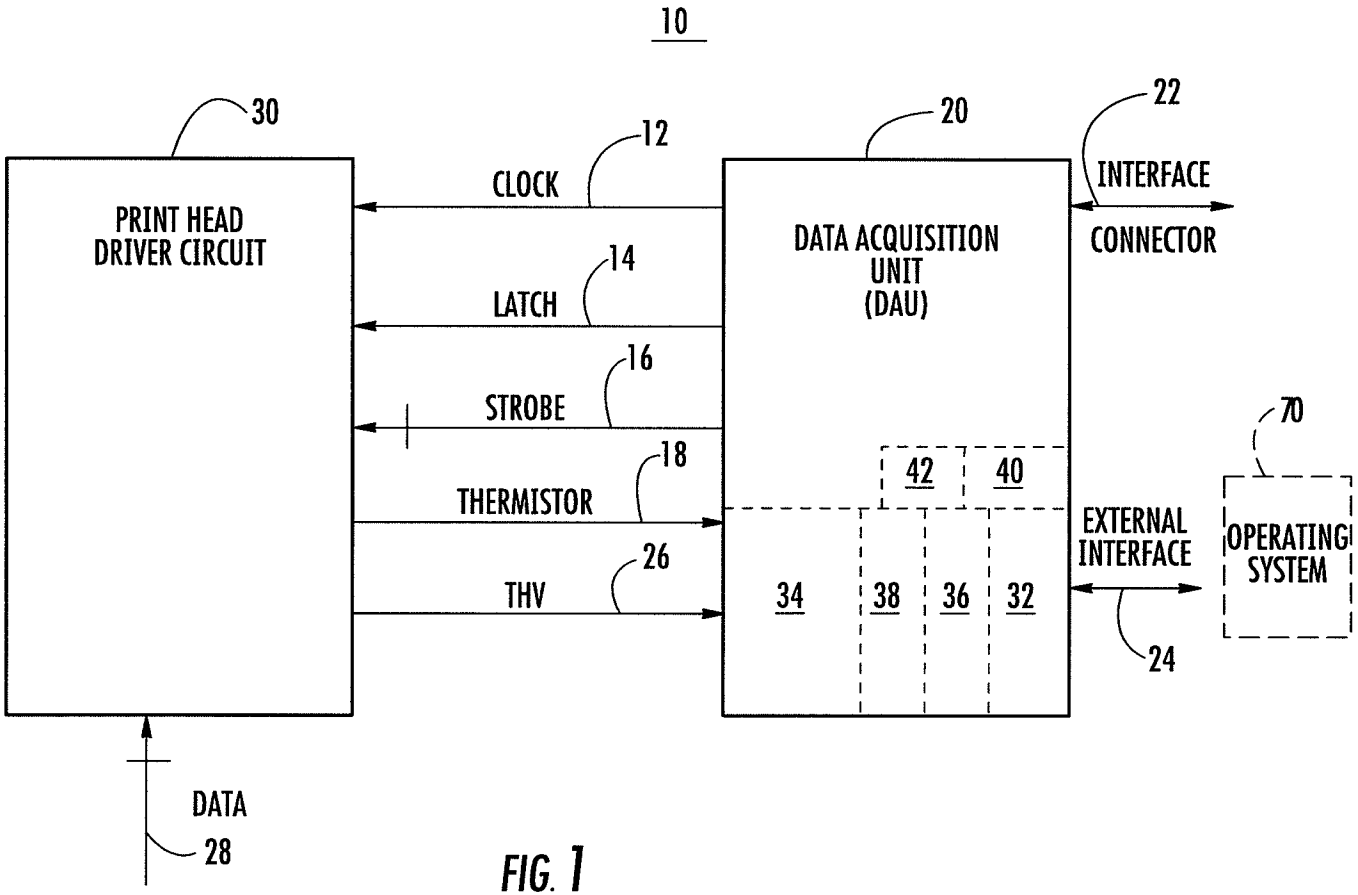
FIG. 1 is a block diagram of an exemplary embodiment of a printing system incorporating the present invention.
Figure 2:
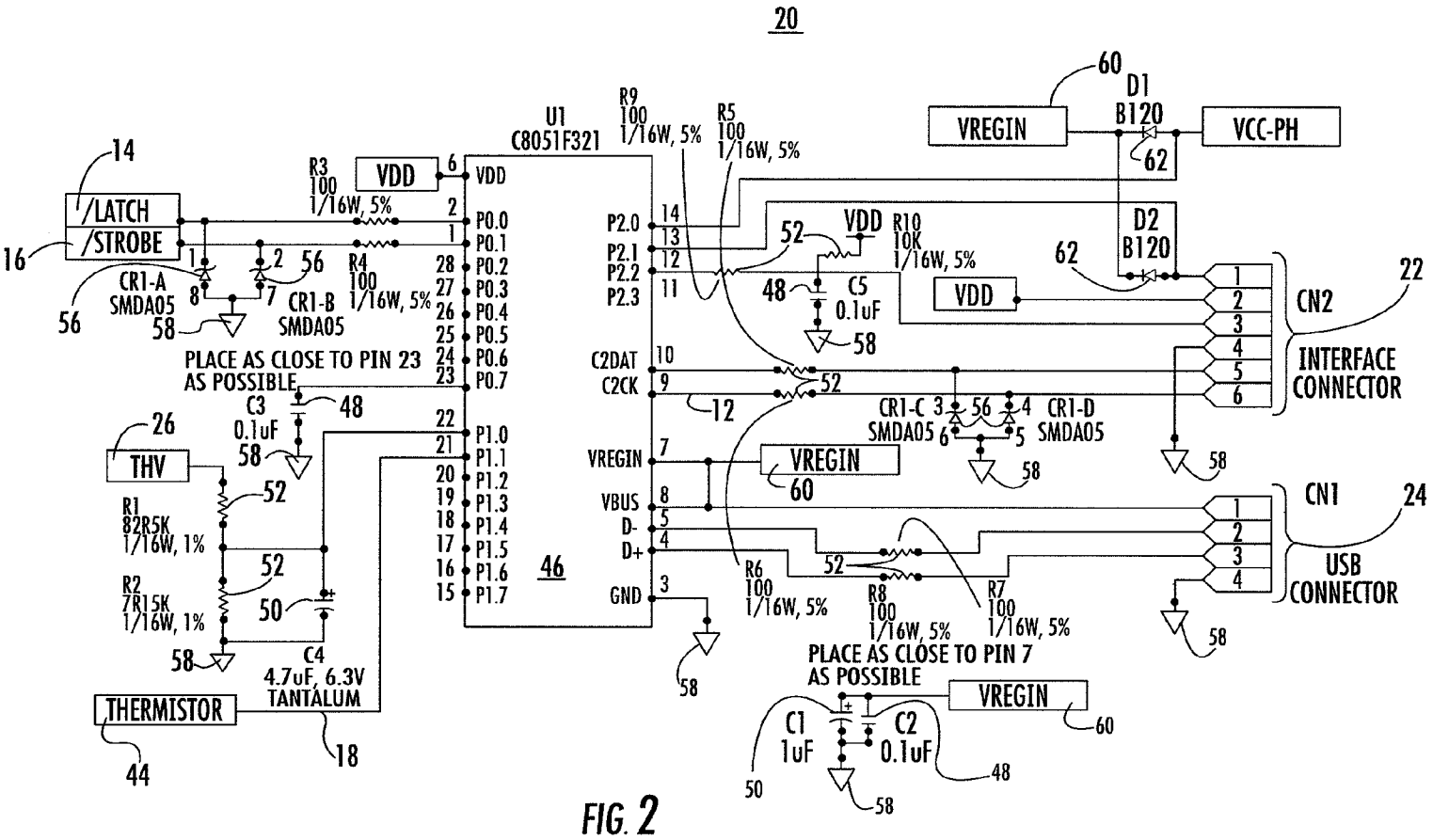
FIG. 2 is a schematic diagram of a preferred embodiment of a DAU of the printing system of FIG. 1.
Figure 3:
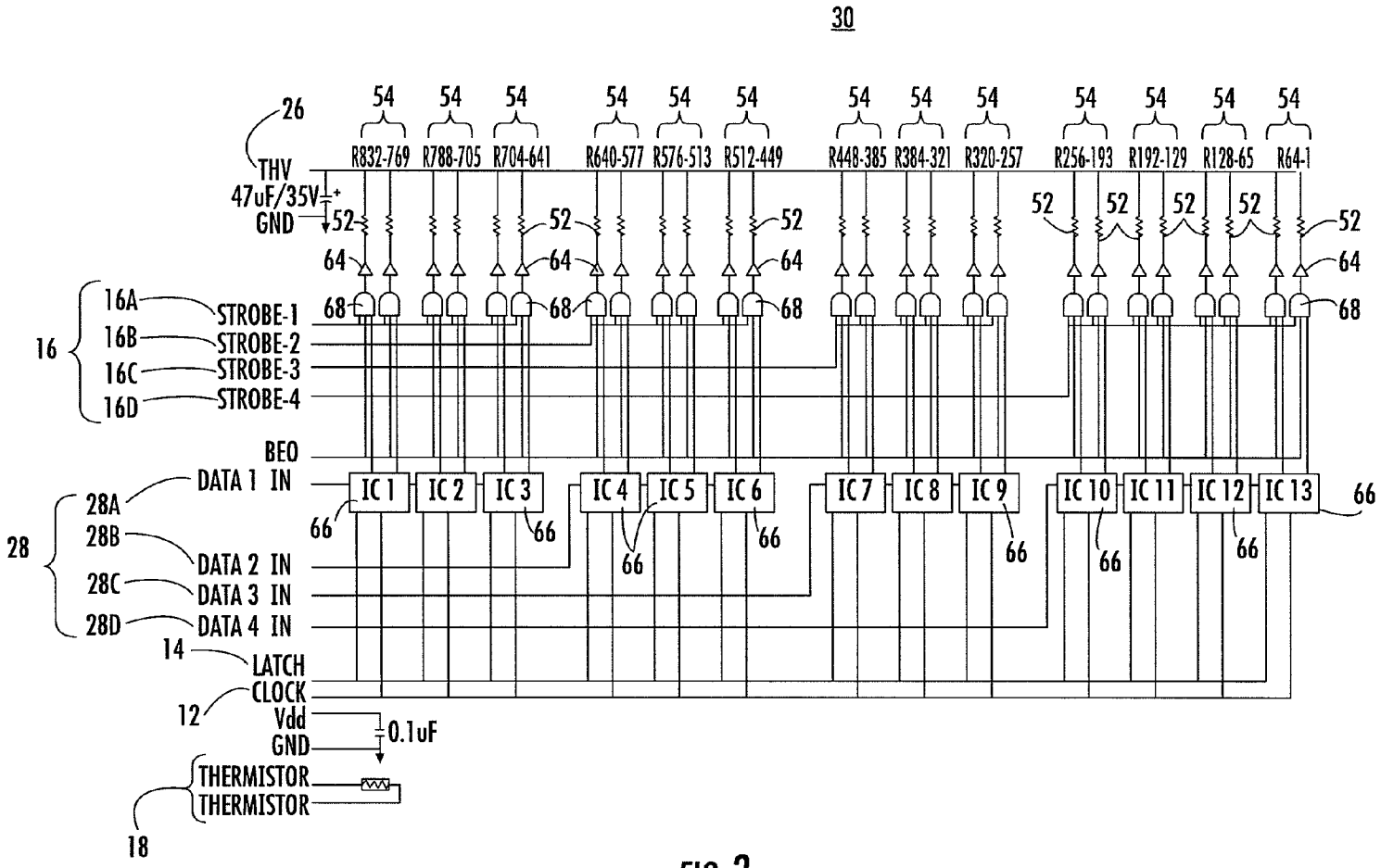
FIG. 3 is a schematic diagram of an exemplary print head driver circuit of a printing system of the type illustrated in FIG. 1.

Referring to FIGS. 1-3, wherein like numerals indicate like elements throughout, an exemplary embodiment of a printing system including a usage monitor of the present invention is shown and generally designated 10. Briefly stated, printing system 10 uses a data acquisition unit ("DAU") 20 to continually monitor actual usage of a print head. It is preferred that the DAU 20 periodically sweep across all print head functions to acquire periodic data regarding the operating environment of the print head and the status of the print head.

The printing system 10 shown in FIG. 1 preferably includes the thermal print head and the DAU 20. However, the DAU 20 can be separate from the print head without departing from the present invention. When the DAU 20 is provided in a stand alone package, it is separate from the print head board, but is equipped with a connector to be in communication with a pre-existing print head or printing systems. Through monitoring, errors in operation or in the printer environment that may lead to premature failure can be detected early, and preferably transmitted to a monitoring station. For example, if a thermal print head is designed to be used with a specific voltage range and it is used with a different range, the DAU 20 will communicate the problem prior to print head failure and permit corrective action.

In the preferred implementation, the DAU 20 allows for: storing of predetermined data prior to initial use by an end user; comparing and analyzing print head data during use; storing and transferring of print head data; and, when connected externally, processing requests for stored data.

Referring to FIG. 3, an exemplary print head driver circuit 30 for use with a thermal print head according to the exemplary configuration of FIG. 1. Other print head driver circuits can be used with the printing system 10 of the present invention and the specific circuit will depend upon the type of print head used. The DAU 20 of FIG. 1 is in communication with the print head driver circuit 30 through the communication connection 28.

The structure of an exemplary DAU 20 is shown in FIG. 2. The DAU 20 preferably includes a microcontroller 46. The microcontroller 46 preferably monitors and detects a clock signal 12, a latch signal 14, and a strobe signal 16 to the print head driver circuit 30. The microcontroller 46 preferably receives a thermistor signal 18 and a thermal head voltage (hereinafter referred to as "THV") signal 26 from the print head driver circuit 30. A standard five volt (5 V) line in most printers is shown as "VDD". The component designated "VCC-PH" can be used to apply an external voltage to the print head.

The table below details components that may be used to assemble DAU 20, as it is shown in FIG. 2.

| Schematic Label | PART # | DESCRIPTION | Manufacturer |
|---|---|---|---|
| U1 | C8051F321 | MICROCONTROLLER | SILICON LABORATORIES |
| CR1 | SMDA05 | TVS NETWORK S0–8 | MICROSEMI |
| D1, 2 | B120 | SCHOTTKY DIODE SMA PACKAGE | DIODES INC. |
| R1 | ERJ-2RKF8252? | 82 R 5K OHM, 1/16 W, 1%, 0402 PACKAGE | PANASONIC |
| R2 | ERJ-2RKF7151? | 7 R 15K OHM, 1/16 W, 1%, 0402 PACKAGE | PANASONIC |
| R3–9 | ERJ-2GEJ101? | 100 OHM, 1/16 W, 5%, 0402 PACKAGE | PANASONIC |
| R10 | ERJ-2GEJ103? | 10K OHM, 1/16 W, 5%, 0402 PACKAGE | PANASONIC |
| C1 | ECS-T1AZ105? | 1 uF, 10 WVDC, TANTALUM CAPACITOR | PANASONIC |
| C2, 3, 5 | ECJ-0EB1A104K | 0.1 uF, 10 WVDC, CERAMIC CAPACITOR | PANASONIC |
| C4 | ECS-T1AZ475? | 4.7 uF, 10 WVDC, TANTALUM CAPACITOR | PANASONIC |
| CN1 | 787616-1 | USB CONNECTOR | AMP |
| CN2 | DF13-6P-1.25DS | 6 POSITION, 1.25 MM RT. ANGLE HEADER | HIROSE |

The DAU 20 preferably includes at least one memory 34 and multiple electrical components that are in communication with the microcontroller 46. The memory 34 may include any suitable type or combination of memories, such as FLASH, EEPROM, EPROM, RAM, or the like. Other electrical components shown in the illustrated circuit are: capacitors 48, polarized fixed capacitors 50, resistors 52, zener diodes 56, grounds 58, voltage regulator inputs 60, and diodes 62. The particular electrical components, as well as the illustrated circuit configuration, can be varied without departing from the scope of the present invention. Referring again to FIG. 1, the print head driver circuit 30 shown in block form receives a communication signal 28 to communicate the printing data to the print head from the on board driver circuit shown in exemplary detail in FIG. 3.

It is preferred that the DAU 20 be integrated with the print head to provide a "smart" print head, however, it may be interfaced with an external operating system 70. The operating system 70 can be a personal computer, a local server, or a remote server that is communicated with via a wireless interface or a physical network.

Within DAU 20, a usage tracking module 32 operates to determine an amount of linear printing performed by the print head. Data from the usage tracking module 32 allows analysis of the print head's probable operational life. The usage tracking module 32 provides information on the average print head longevity and allows refinements to more precisely determine activity issues so performance can be improved upon.

As will be described below, some of the characteristics of the print head which may be determined by the usage tracking module 32 include, but are not limited to: (1) pulse repetition analysis/characterization; (2) print speed analysis; (3) voltage analysis/characterization; (4) tracking open and shorted elements; (5) encrypted data transmission; (6) environmental data acquisition; and/or (7) operational data acquisition. It is preferred that the DAU 20 use an analog/digital converter to read the thermal head voltage (i.e., the voltage in which the print head is operating) and to read the thermistor signal 18 to determine the print head operating temperature.

Referring to again FIG. 3, the exemplary thermal print head driver circuit 30 the thermal print head includes a print surface capable of producing eight hundred thirty-two (832) ink dots. Each dot is created by ink separated from an ink reservoir in the print head due to heat generated by an associated resistor 52 or other heating element. Referring to the top of FIG. 3, locations associated with potential ink dots 54 are arranged in groups of 64 to simplify the schematic. The number of ink drops firing from the print head is determined, in part, by the data signal 28 which preferably is received as a multiplexed signal of multiple parallel data signals 28A-28D.

The data signals 28A-28D are processed by data latches 56 that are controlled by the latch signal 14 and the clock signal 12 from the DAU 20. The data latches 66 (also known as "flip flops") output signal to AND gates 68. The AND gates 68 also receives a strobe signal 16 from the DAU 20. The strobe signal 16 from the DAU 20 preferably includes multiple strobe signals 16A-16D. The AND gates process the output of the flip flops 66 and the strobe signals 16A-16D to provide a digital signal. The resultant digital signal is processed by an inverter 64 and then passed through a heating or resistive element 52. When current is passed through the heating or resistive element 52, an ink dot is ejected from an associated location of the ink reservoir of the print head.

It is preferred that the controller 46 has a dedicated interrupt that is edge sensitive per each active low transition of the print head latch signal, which is active once per each print line. The processing of the interrupt will include, but not be limited to, incrementing a printer line counter value that is stored in the print head sensor and control circuit's memory 34. It is preferred that the DAU 20 have a dedicated interrupt that occurs at predetermined intervals. During the interrupt, the DAU 20 samples data channels conveying information from the print head.

Referring again to FIG. 1, it is preferred that the DAU 20 includes a voltage tracking module 38. The voltage tracking module 38 preferably determines the operating voltage of the print head. The operating voltage of the print head can be measured by determining an average print head voltage, a maximum print head voltage, and/or a minimum print head voltage. The maximum voltage that the print head is operated at provides useful information as to whether the print head was used under proper operating conditions. If the average print head voltage, the minimum print head voltage, or the maximum print head voltage is outside of normal operating ranges, the corresponding print head data can be useful when evaluating a print head malfunction or performance quality.

A data transfer module 36 operates on the DAU 20 and is configured to send data to the external interface 24. It is preferred, but not necessary, that the external interface 24 is a USB interface. The external interface 24 is preferably interrupt driven and the data transfer module 36 is preferably capable of encrypting data communications that are sent to another operating system 70. The interface connector 22 is preferably a dedicated port for programming the microcontroller 46 directly. The interface connector 22 is used to initially program the DAU 20. The data transfer module 36 will preferably monitor for external requests for information from an external operating system 70. When the data transfer module 36 receives a request, it can reply by sending data stored in memory 34 through the external interface 24 to the external system 70. Preferably the data transfer module 36 requires a password prior to transmitting data.

It is preferred that the DAU 20 include a printer power module 40 that operates to determine an amount of power at which the printing system operates. The wattage at which a particular print head operates is critical to both print quality and the longevity of the print head.

It is preferred that the DAU 20 stored data include data on the date of manufacture of the print head and the serial number of the print head in the memory 34. Additionally, it is preferred that the information include operational and design specifications of the print head. Intended use and design specification data may include: (1) the product type/machine models with which the print head is compatible; (2) the print resolution (dots per inch) at which the print head is designed to typically function; (3) the resistance with which the print head is designed; (4) the wattage at which the print head is designed to operate; (5) information about the product warranty (preferably quantified in an amount of linear inches); and (6) a maximum operating pressure at which the print head is designed to function.

The print resolution information is important because the product function for the printing system 10 is preferably measured in an amount of linear printing at a specific print resolution. If a different print resolution is used, the product may fail prematurely or premature failure may signal the need that the head be modified accordingly to take into account conditions reflected in the monitoring by DAU 20.

The resistance at which the print head should operate is important because it is related directly to the voltage that the print head experiences when operating at a preset wattage.

Referring again to FIG. 1, it is preferred that the printing system 10 include a temperature sensor in communication with the DAU 20 for monitoring the operating temperature of the print head. A temperature tracking module 42 obtains data from the thermistor 44 and thermistor signal 18.

The present invention includes a method of monitoring print head performance. The method is preferably practiced using the printing system 10 and DAU 20 described above. The method of the present invention preferably includes evaluating data representing the amount of completed linear printing to determine a percentage of an expected operational life provided by the print head prior to malfunction. This percentage can be used along with other collected performance and operation data to diagnose the cause of failure of the print head.

The percentage can be used to provide analysis to determine a warranty credit toward a replacement print head or possible product improvements based on failure analysis. Examples of data that is useful for diagnostic purposes or that may be required for warranty evaluations may include, but are not limited to: (1) the specific machine model of the printer in which the print head is installed; (2) whether the print head is being used for direct thermal printing or thermal transfer printing; (3) identification of a label material manufacturer so that the label coatings exposed to the print head can be determined; (4) identification of a label material product code so that specific paper types and thicknesses can be determined; (5) identification of a type of adhesive used with a pressure sensitive label; (6) identification of a ribbon material manufacturer so that specific ribbon coatings can be identified; (7) identification of a ribbon product code so that ribbon characteristics can be identified; (8) data regarding whether the ribbon is a wax ribbon, a wax-resin ribbon, or a resin ribbon, since the type of ribbon affects the operating conditions and the expected operational life of the print head; (9) data regarding environmental conditions, such as dust, humidity, temperature, etc.; (10) data regarding pressure settings of the print engine; (11) identification of a print density setting so that whether the setting is suitable for a particular media can be determined; (13) data regarding frequency of cleaning of the print head; (14) data regarding method of cleaning by a user; (15) data regarding the date of installation of the print head by the user; (16) data regarding a date of removal of the print head so that volume of ink remaining can be estimated; and (17) data regarding a cause of failure, such as mechanical abrasive wear, operator inflicted scratches, thermal breakdown, or the like.

As detailed above, the method of the present invention preferably includes collecting data regarding the type of medium on which the print head is printing and collecting data regarding operational characteristics of the print head during printing. Examples of operational characteristics, such as voltage, speed, power, or the like, are described above. The recording and/or monitoring of this information provides diagnostic information that is not generally observable during a typical visual inspection. By monitoring characteristics, such as voltage, during print head operation, inappropriate operating conditions can be used to prevent print head failure and for product improvement.

The operational characteristic data is preferably correlated with the type of medium data to provide quantifiable data regarding the compatibility of the medium used with the print head. The method of the present invention provides quantifiable compatibility data useful to manufacturers of print heads and the media used with the print heads. Thus, the method of the present invention allows the establishment of bench marks for various combinations of print heads and printable media.

Analyzing the bench marks allows a print head manufacturer to design a superior product. The bench mark data also allows the print head manufacturer to focus on delivering the most value at the lowest cost by optimizing other parameters.

It is recognized by those skilled in the art that changes may be made to the above described embodiments of the invention without departing from the broad inventive concept thereof. For example, the print head may include only the print head driver head 30 or may include the print head driver circuit 30 and the print head sensor and control circuit 20 without departing from the scope of the present invention. It is understood, therefore, that this invention is not limited to the particular embodiments disclosed, but is intended to cover all modifications which are within the spirit and scope of the invention as defined by the appended claims and/or shown in the attached drawings.

What is claimed is:

1. A print head comprising:

a print head driver circuit;

at least one memory configured to store data;

a data acquisition unit integrated with the print head, said data acquisition unit comprising a microcontroller, wherein the microcontroller comprises a dedicated interrupt that is edge sensitive per each active low transition of a print head latch signal, wherein the print head latch signal is active once per each print line.

2. The print head of claim 1, wherein the microcontroller, in response to processing the interrupt, increments a printer line counter value.

3. The print head of claim 2, wherein the printer line counter value is stored in the at least one memory of the print head.

4. The print head of claim 1, wherein the data acquisition unit, in response to the microcontroller processing the interrupt, samples data channels conveying information from the print head.

5. The print head of claim 4, wherein the data channels conveying information from the print head comprise a thermistor signal and a thermal head voltage signal.

6. The print head of claim 5, wherein the sampled data from the thermistor signal and the thermal head voltage signal are stored in the at least one memory.

7. The print head of claim 1, further comprising a printer power module configured to determine an amount of power used to operate the print head.

8. The print head of claim 7, wherein the data acquisition unit, in response to the microcontroller processing the interrupt, samples a data channel conveying amount of power used to operate the print head.

9. The print head of claim 1, wherein the data acquisition unit is configured to monitor a clock signal, a latch signal, a strobe signal, a thermistor signal, and a voltage signal, wherein the voltage signal is the operating voltage of the thermal print head.

10. The print head of claim 9, further comprising an external interface, wherein the data acquisition unit is configured to send data to the external interface.

11. The print head of claim 10, wherein data sent from the external interface to a remote operating system is encrypted.

12. A method of operating a print head comprising:

receiving at a microcontroller of a data acquisition unit a low transition of a print head latch signal, wherein the print head latch signal is active once per each print line;

processing the low transition of the print head latch signal as an interrupt;

incrementing a printer line counter value in response to processing the low transition of the print head latch signal; and storing the printer line counter value in a memory on the print head.

13. The method of claim 12, further comprising:

sampling data channels conveying information from the print head in response to processing the interrupt.

14. The method of claim 13, wherein the data channels conveying information from the print head comprise a thermistor signal and a thermal head voltage signal.

15. The method of claim 14, further comprising:

storing the information from the sampled data channels in the memory on the printhead.

16. The method of claim 12, further comprising:

determining an amount of power used to operate the print head.

17. The method of claim 12, further comprising:

monitoring a clock signal, a latch signal, a strobe signal, a thermistor signal, and a voltage signal, wherein the voltage signal is the operating voltage of the thermal print head.

18. The method of claim 12, further comprising:

sending data from the data acquisition unit to an external interface.

19. The method of claim 18, further comprising:

encrypting the data and sending the encrypted data from the external interface.

* * * * *